US012396560B2

(12) United States Patent
Zhang

(10) Patent No.: US 12,396,560 B2
(45) Date of Patent: Aug. 26, 2025

(54) ROCKING CHAIR AND A BRACKET THEREOF

(71) Applicant: Suzhou Mingrui Design Consulting Co., Ltd., Jiangsu (CN)

(72) Inventor: Hailin Zhang, Jiangsu (CN)

( * ) Notice: Subject to any disclaimer, the term of this patent is extended or adjusted under 35 U.S.C. 154(b) by 404 days.

(21) Appl. No.: 17/956,634

(22) Filed: Sep. 29, 2022

(65) Prior Publication Data

US 2024/0081534 A1 Mar. 14, 2024

(30) Foreign Application Priority Data

Sep. 14, 2022 (CN) ..... 202211115627.2

(51) Int. Cl.
*A47C 4/28* (2006.01)
*A47C 3/02* (2006.01)

(52) U.S. Cl.
CPC ..... *A47C 3/02* (2013.01); *A47C 4/28* (2013.01); *A47C 4/283* (2013.01)

(58) Field of Classification Search
CPC .. A47C 3/02; A47C 4/28; A47C 4/283; A47C 4/286; A47C 7/002; A47C 3/04; A47C 4/00
See application file for complete search history.

(56) References Cited

U.S. PATENT DOCUMENTS

| | | | | |
|---|---|---|---|---|
| 2019/0290007 | A1* | 9/2019 | Chen | A47C 4/286 |
| 2020/0281356 | A1* | 9/2020 | Yang | A47C 5/10 |
| 2020/0305606 | A1* | 10/2020 | Chen | A47C 4/286 |
| 2023/0165373 | A1* | 6/2023 | Chen | A47C 4/30 297/19 |
| 2023/0270253 | A1* | 8/2023 | Chen | A47C 4/286 297/451.8 |
| 2024/0172870 | A1* | 5/2024 | Yao | A47C 7/00 |
| 2024/0245218 | A1* | 7/2024 | Chen | A47C 4/286 |
| 2025/0040714 | A1* | 2/2025 | Xia | A47C 3/02 |

* cited by examiner

*Primary Examiner* — Robert Canfield

(57) ABSTRACT

The invention discloses a bracket for a foldable rocking chair, comprising a central cross component, two sets of support components, two overturning rods, and two sets of linkage rod components; the two support components are connected by the center cross component; one end of each overturning rod is connected with a support component and can rotate at the position where the overturning rod is connected with the support component; one end of the linkage rod component is connected with the overturning rod, and the other end is connected with the central cross component or support component; wherein the linkage rod component can move with the rotation of the overturning rod, at the same time, the movement of the linkage rod components can change the distance between the two support components.

11 Claims, 9 Drawing Sheets

ROCKING CHAIR AND A BRACKET THEREOF

1. TECHNICAL FIELD

The invention relates to a portable chair, in particular to a rocking chair and a bracket thereof.

2. BACKGROUND ART

At present, the folding armchairs used for tourism and leisure are basically designed to be foldable for the convenience of carrying, from the analysis of the structure of the folding armchair in the existing market, in order to achieve the object of folding and shrinking, the bracket for the existing outdoor foldable rocking chair uses the sliding sleeve, and the height after folding is large, and the sliding sleeve must be locked after the bracket is opened to achieve the state of use, for example, an invention, the application number is CN 201920965933.2, the name is a folding chair with a footrest and a folding bracket thereof, which realizes folding and opening through the linkage mechanism and the supporting mechanism, but the length of the upright rod is long, and the length cannot be shortened even after being folded, and the volume is large and inconvenient to use.

3. SUMMARY OF THE INVENTION

To solve the above technical problems, the technical scheme provided by the invention is as follows: a bracket for a foldable rocking chair, comprising a central cross component, two sets of support components, two overturning rods, and two sets of linkage rod components;

The two support components are connected by the center cross component; One end of each overturning rod is connected with a support component and can rotate at the position where the overturning rod is connected with the support component;

One end of the linkage rod component is connected with the overturning rod, and the other end is connected with the central cross component or support component;

Wherein the linkage rod component can move with the rotation of the overturning rod, at the same time, the movement of the linkage rod components can change the distance between the two support components;

Preferably, each of the support component comprises two upper support rods, two lower support rods, an upper connecting piece and a bottom connecting piece, one end of the two upper support rods is hinged with the upper connecting piece respectively, and the other end is in contact with the ground and provided with foot pads, one end of the two lower support rods is hinged with the bottom connecting piece respectively, and the other end is hinged with the two upper support rods respectively; the upper connecting piece is hinged with one end of the overturning rod.

Preferably, the upper connecting piece comprises an upper connecting piece main body and two U-shaped pieces, the two U-shaped pieces are symmetrically arranged on both sides of the upper connecting piece main body.

Preferably, the upper connecting piece main body is hinged with one end of the overturning rod, so that the overturning rod rotates around the hinged position, the upper connecting piece is provided with limiting grooves on the side hinged with the overturning rod, and the limiting grooves are clamped with the overturning rod and the linkage rod component when the overturning rod rotates at a certain angle.

Preferably, the distance between the upper connecting piece and the bottom connecting piece changes when the linkage rod component rotates with the overturning rod, at the same time, the connection position between the two upper support rods and the two lower support rods changes.

Preferably, the two upper support rods are respectively the front upper support rod and the rear upper support rod, and the two lower support rods are respectively the front lower support rod and the rear lower support rod; the front upper support rod is hinged with the front lower support rod, and the rear upper support rod is hinged with the rear lower support rod, when the linkage rod component rotates with the overturning rod, the hinged position of the front upper support rod and the front lower support rod changes, at the same time, the hinged position of the rear upper support rod and the rear lower support rod changes.

Preferably, each linkage component includes at least one linkage rod, linkage rods are hinged to overturning rods, at least one linkage rod is clamped with the upper connecting piece when the overturning rod rotates at a certain angle.

Preferably, upper connecting pieces and bottom connecting pieces are respectively connected with one end of the central cross component.

Preferably, the central cross component includes at least one set of cross tubes.

Preferably, the central cross component is a set of cross tubes, which includes a first cross tube and a second cross tube that are cross-hinged with each other, wherein one end of the first cross tube is connected to the upper connecting piece of one support component, and the other end is hinged with the bottom connection piece of the other support component; one end of the second cross tube is hinged with the bottom connection piece of one support component, and the other end is connected to the upper connection piece of the other support component.

Preferably, the lower end of the first cross tube is hinged with the lower end of a linkage rod component, and the other end of the other linkage rod component is hinged with the lower end of the second cross tube.

Preferably, the central cross components are two sets of cross tubes, wherein one central cross component includes a third cross tube and a fourth cross tube hinged to each other, and the other central cross component includes a fifth cross tube and a sixth cross tube hinged to each other, wherein one end of the third cross tube is connected with the upper connecting piece of one support component, and the other end is hinged with one end of the fifth cross tube; one end of the fourth cross tube is connected with the bottom connecting piece of one support component, and the other end is hinged with one end of the sixth cross tube; the other end of the fifth cross tube is connected with the upper connecting piece of the other support component, the other end of the sixth cross tube is connected with the bottom connecting piece of the other support component.

Preferably, bottom connecting pieces are hinged with linkage rod components.

Preferably, the rotation of one of the overturning rods can make the other overturning rod rotate or the two overturning rods can rotate simultaneously.

The invention also discloses a rocking chair, comprising the bracket for the foldable rocking chair as described above, the bracket for the foldable rocking chair is provided with a cushion cloth.

Compared with the prior art, the invention has the following advantageous effects: the scheme uses a linkage mechanism combining many linkage rods and overturning rods, cleverly uses the single-sided limit of the overturning tube, and at the same time uses the lever principle to change the distance between the two ends of the central cross component by rotating the overturning rod and the linkage rod through its rotation point, so as to realize the opening and folding of the bracket; rotating and folding can reduce the height of the entire bracket by half after folding, so as to achieve the object of reducing the volume after folding, in addition, after the bracket is opened, the automatic locking function is realized through the single-sided limit of the overturning rod and ensuring that the limit of the bracket overturning rod and the inward force are in the same direction, and the process of manual unlocking is not required, which allows consumers to fold the entire bracket conveniently and quickly.

4. BRIEF DESCRIPTION OF ACCOMPANY DRAWINGS

5. SPECIFIC EMBODIMENT OF THE INVENTION

Figure 1:
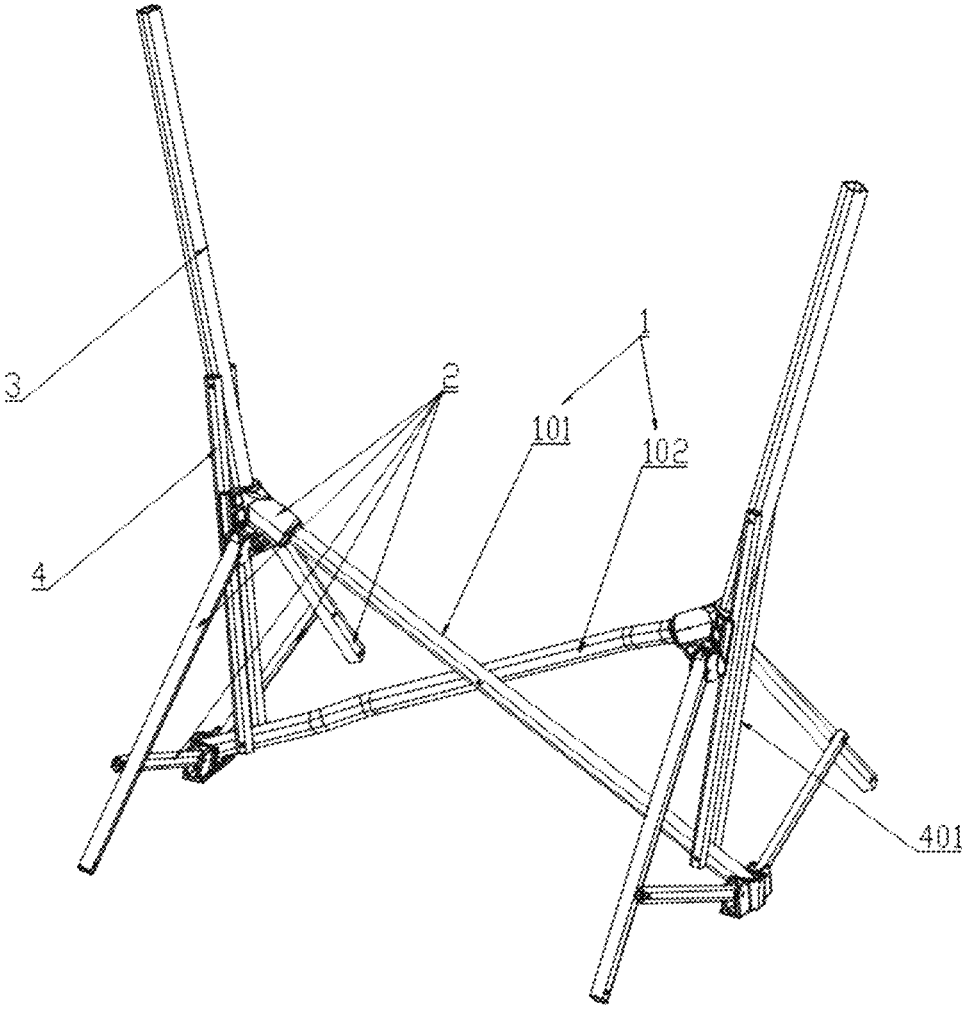
FIG. 1 is a schematic structural diagram of Embodiment 1 of a bracket for a rocking chair of the invention.
Figure 2:
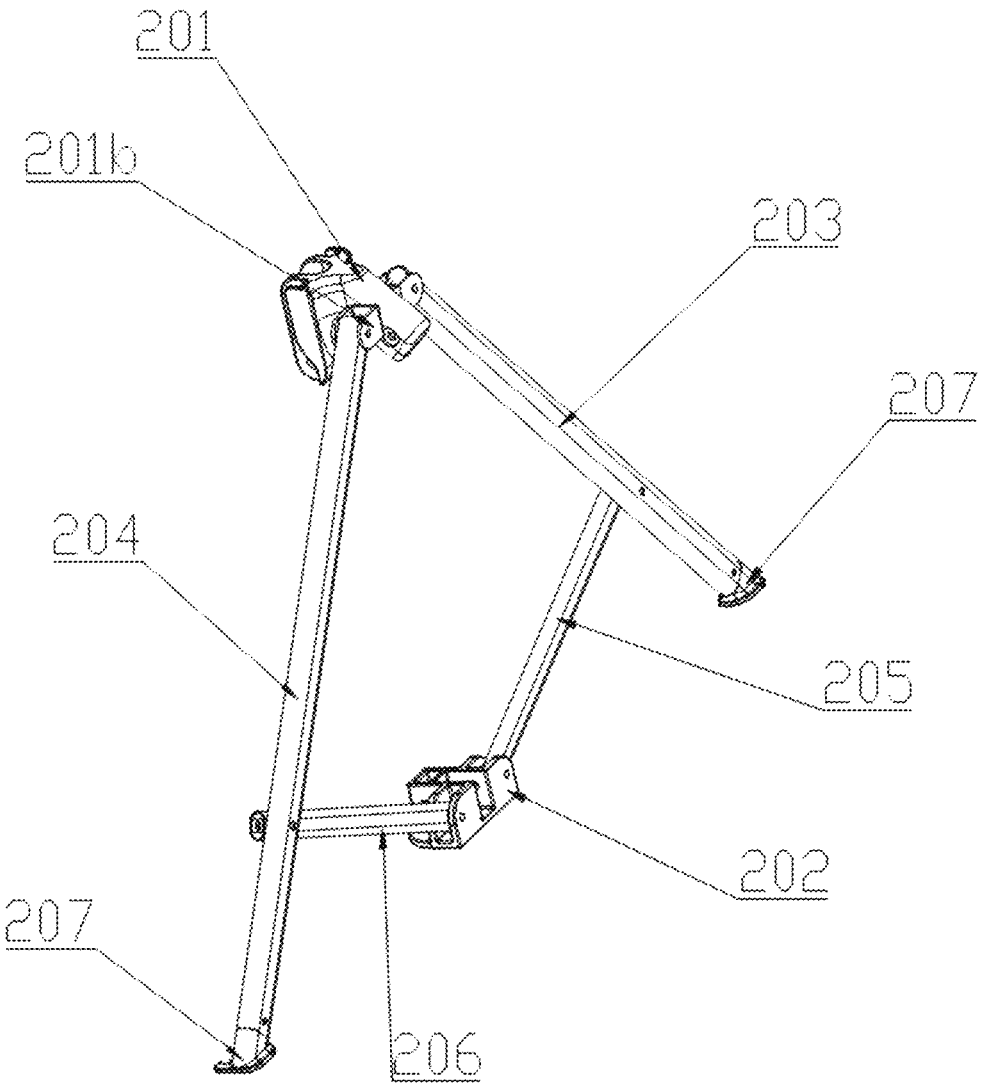
FIG. 2 is a schematic structural diagram of the support component in Embodiment 1 of a bracket for a rocking chair of the invention.
Figure 3:
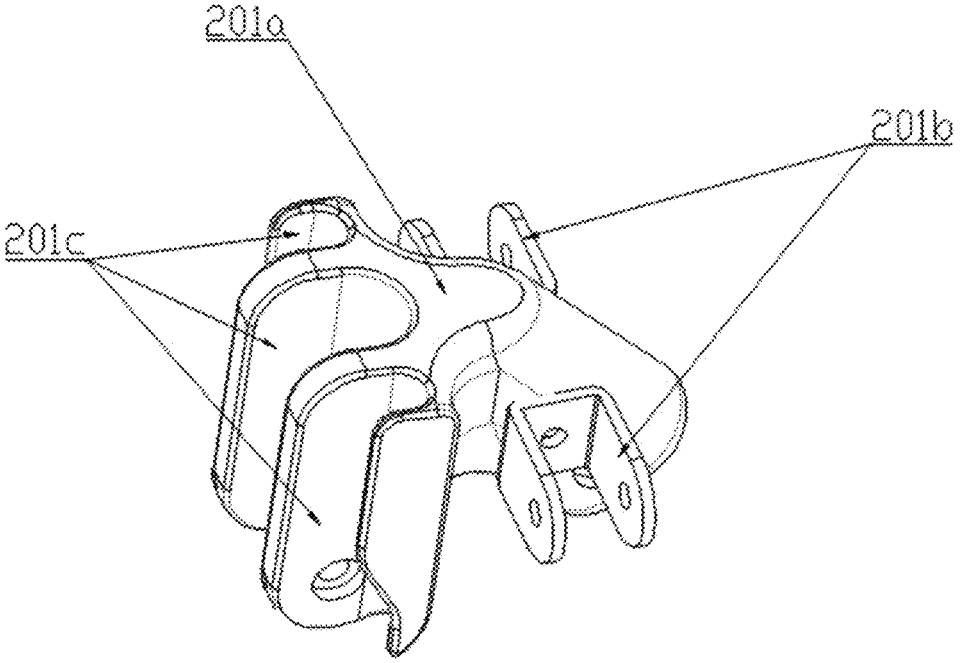
FIG. 3 is a schematic structural diagram of the upper connection piece in Embodiment 1 of a bracket for a rocking chair of the invention.
Figure 4:
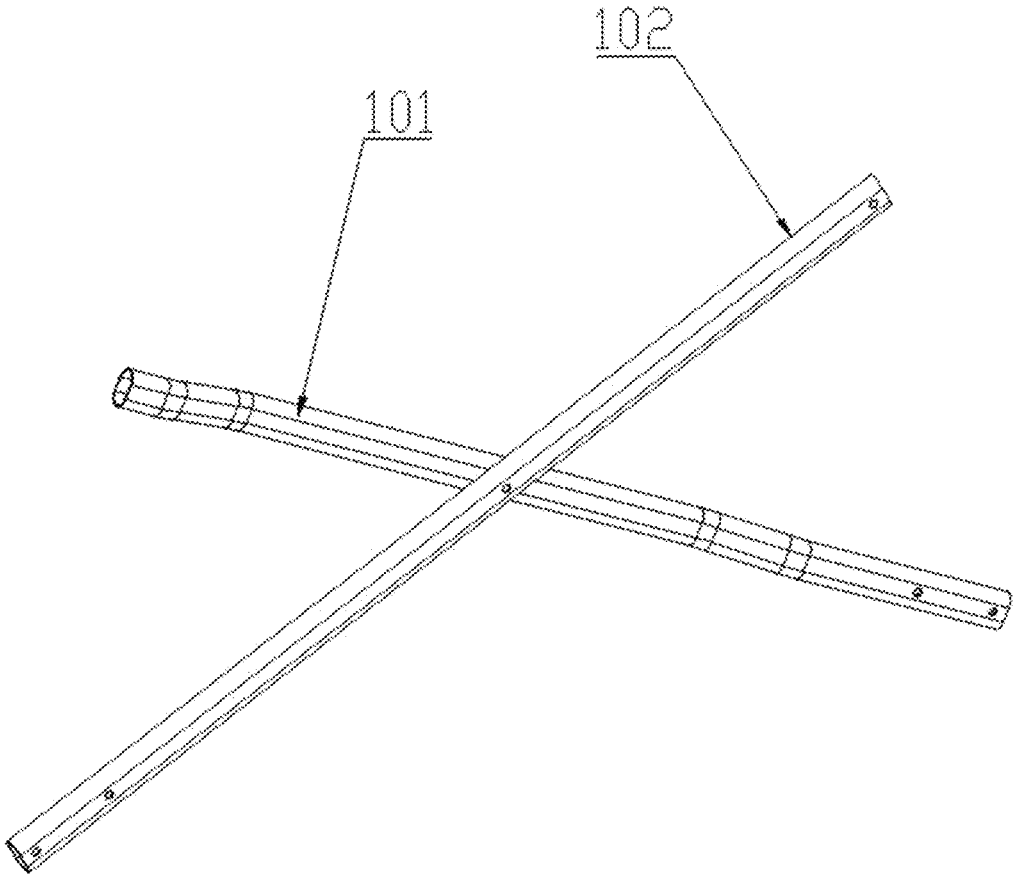
FIG. 4 is a schematic structural diagram of the central cross component in Embodiment 1 of a bracket for a rocking chair of the invention.

In order to make the objects, technical schemes and advantages of the embodiments of the invention clearer, the technical schemes in the embodiments of the invention will be clearly and completely described below in combination with the accompanying drawings in the embodiments of the invention, obviously, the described embodiments are some, but not all embodiments of the invention. The components of the embodiments of the invention generally described and illustrated in the drawings herein may be arranged and designed in a variety of different configurations.

In the description of the invention, it should be understood that the orientation or positional relationship indicated by the terms "center", "upper", "lower", "left", "right", "vertical", "horizontal", "inner", "outer" and so on are based on the orientation or positional relationship shown in the accompanying drawings, or the orientation or positional relationship that product of the invention is usually placed in when it is used, only for the convenience of describing the invention and simplifying the description, rather than indicating or implying that the indicated device or element must have a specific orientation, as well as a specific orientation structure and operation, therefore, it should not be construed as a limitation of the invention. In addition, the terms of "first", "second", "third" and so on are only used to differentiate the description, and should not be construed as indicating or implying relative importance.

In addition, if the terms "horizontal", "vertical", "overhanging" and other terms appear, it does not mean that the component is required to be absolutely horizontal or overhanging, but can be slightly inclined. For example, "horizontal" simply means that its direction is more horizontal than "vertical", it does not mean that the structure must be completely horizontal, but can be slightly inclined.

In the description of the invention, "a plurality of" means at least two.

In the description of the invention, it should also be noted that the terms of "arrange", "install", "link", "connect", etc., should be generally understood unless there are specific restrictions or stipulations, for example, the "connect" may refer to fixed connection, detachable connection or integral connection; the "connect" may also refer to mechanical connection or electrical connection; the means of "connect" may be directly connected or indirectly connected through an intermediate medium, and may be internal communication between the two elements. For those skilled in the art, the specific meaning of the above terms in the invention can be understood according to the specific situation.

Embodiment 1

Referring to FIG. 1-4, this embodiment discloses a bracket for a foldable rocking chair, comprising a central cross component 1, two sets of support components 2, two overturning rods 3, and two sets of linkage rod components 4; one side of the central cross component 1 is respectively distributed with a support component 2, an overturning rod 3 and a linkage rod component 4; wherein the two support components 2 are connected by the center cross component 1; one end of each overturning rod 3 is connected with a support component 2 and can rotate at the position where the overturning rod 3 is connected with the support component 2; in addition, the rotation of one of the overturning rods can make the other overturning rod rotate or the two overturning rods can rotate simultaneously; one end of the linkage rod component 4 is connected with the overturning rod 3, and the other end is connected with the central cross component 1, the linkage rod component 4 can move with the rotation of the overturning rod 3;

Preferably, each of the support component 2 comprises two upper support rods, two lower support rods, an upper connecting piece 201 and a bottom connecting piece 202, one end of the two upper support rods is hinged with the upper connecting piece 201 respectively, and the other end is in contact with the ground and provided with foot pads 207 to increase the contact area with the ground, one end of the two lower support rods is hinged with the bottom connecting piece 202 respectively, and the other end is hinged with the two upper support rods respectively;

Specifically, the upper connecting piece 201 comprises an upper connecting piece main body 201*a* and two U-shaped pieces 201*b*, the two U-shaped pieces 201*b* are symmetrically arranged on both sides of the upper connecting piece main body 201*a*; one side of upper connecting piece main body 201*a* is connected with the central cross component, and the other side is hinged with one end of the overturning rod 3, so that the overturning rod 3 rotates around the hinged position, the upper connecting piece 201 is provided with limiting grooves 201*c* on the side hinged with the overturning rod, and the limiting grooves 201*c* are clamped with the overturning rod 3 and the linkage rod component 4 when the overturning rod 3 is rotated upward by a certain angle, the overturning rod 3 and the linkage rod component 4 are separated from the limiting grooves 201*c* of the upper connecting piece 201 when the overturning rod 3 is rotated downward by a certain angle, each linkage component 4 includes at least one linkage rod 401, linkage rods 401 are hinged to overturning rods 3, at least one linkage rod 401 is clamped with the limiting grooves 201*c* of upper connecting piece 201 when the overturning rod 3 rotates at a certain angle, in this embodiment, each linkage rod component 4 is provided with two linkage rods, which are respectively hinged on both sides of the overturning rod 3.

Specifically, the two upper support rods are respectively the front upper support rod 203 and the rear upper support rod 204, and the two lower support rods are respectively the front lower support rod 205 and the rear lower support rod 206; one end of the front upper support rod 203 is hinged with the U-shaped piece 201*b* on one side of the upper connecting piece 201, and the other end supports the ground, one end of the front lower support rod 205 is hinged with the front upper support rod 203, and the other end is hinged with the bottom connecting piece 202, the hinged connection mode of the rear upper support rod 204 and the rear lower support rod 206 is the same as that of the front upper support rod 203 and the front lower support rod 205, the two upper support rods and the two lower support rods are symmetrically arranged on both sides of the central cross component 1, and two symmetrical triangular structures are formed on both sides of the central cross component 1, and the two triangular structures can provide a more stable support effect; when the linkage rod component 4 rotates with the overturning rod 3, the distance between the upper connecting piece 201 and the bottom connecting piece 202 changes, at the same time, the hinged position of the front upper support rod 203 and the front lower support rod 205 changes, the hinged position of the rear upper support rod 204 and the rear lower support rod 206 changes.

In this embodiment, the central cross component 1 is a set of cross tubes, which includes a first cross tube 101 and a second cross tube 102 that are cross-hinged with each other, the first cross tube 101 and the second cross tube 102 cross to form an X-shaped structure, wherein one end of the first cross tube 101 is connected to the upper connecting piece 201 of one support component 2, and the other end is hinged with the bottom connection piece 202 of the other support component 2; one end of the second cross tube 102 is hinged with the bottom connection piece 202 of one support component 2, and the other end is connected to the upper connection piece 201 of the other support component 2; in this embodiment, the upper connection piece 201 and the bottom connection piece 202 are respectively connected to one end of the central cross component 1; the lower end of the first cross tube 101 is hinged with the lower end of a linkage rod component 4, and the other end of the other linkage rod component 4 is hinged with the lower end of the second cross tube 102.

Embodiment 2

Figure 5:
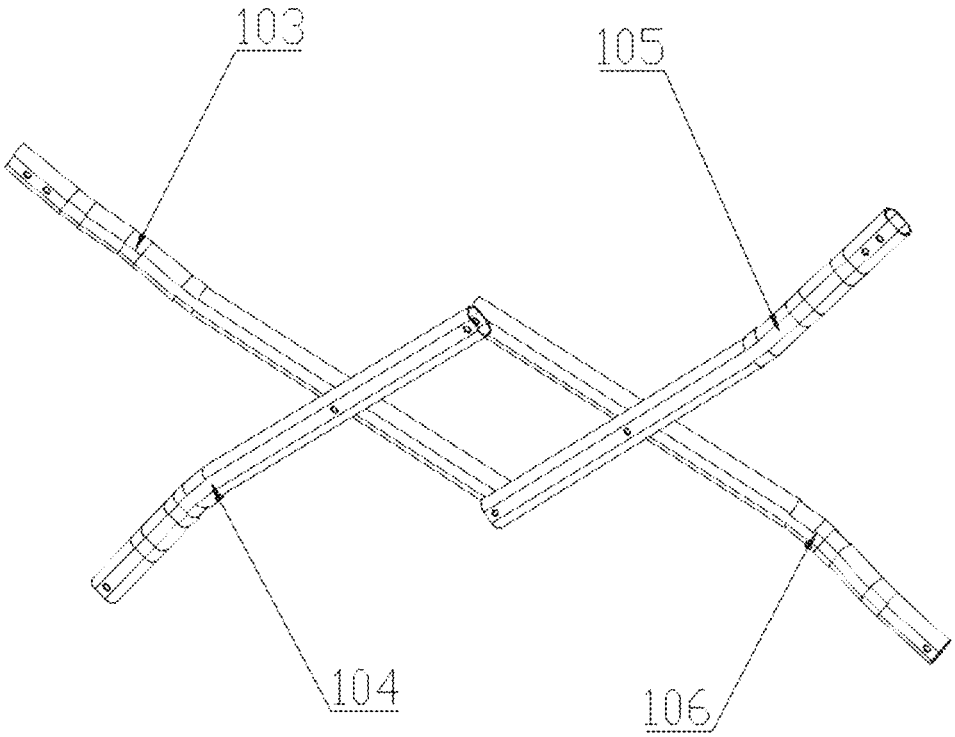
FIG. 5 is a schematic structural diagram of the central cross components in Embodiment 2 of a bracket for a rocking chair of the invention.
Figure 6:
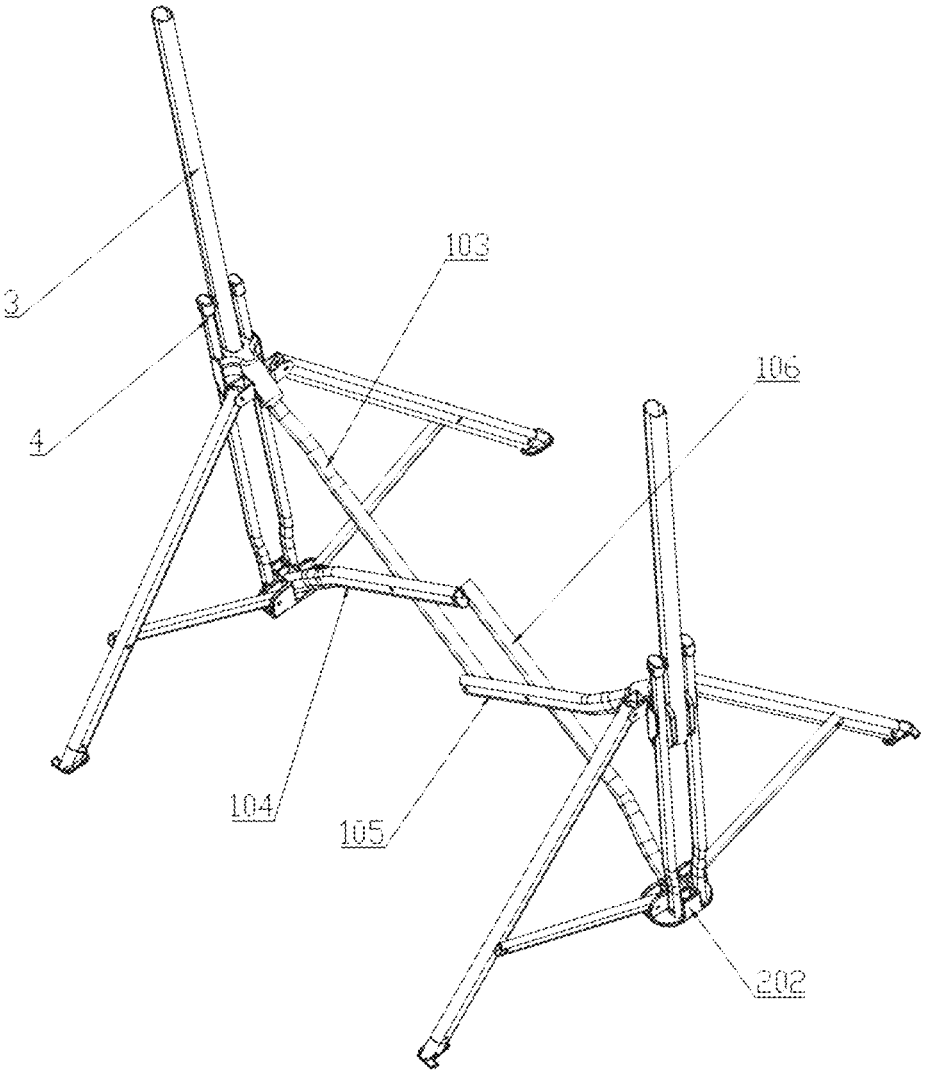
FIG. 6 is a schematic structural diagram of Embodiment 2 of a bracket for a rocking chair of the invention.

Referring to FIG. 5-6, the difference between this embodiment and Embodiment 1 is that in this embodiment, the central cross components are two sets of cross tubes and form a double X-shaped structure, specifically, one central cross component includes a third cross tube 103 and a fourth cross tube 104 hinged to each other, and the other central cross component includes a fifth cross tube 105 and a sixth cross tube 106 hinged to each other, wherein one end of the third cross tube 103 is connected with the upper connecting piece 201 of one support component 2, and the other end is hinged with one end of the fifth cross tube 105; one end of the fourth cross tube 104 is connected with the bottom connecting piece 202 of one support component 2, and the other end is hinged with one end of the sixth cross tube 106; the other end of the fifth cross tube 105 is connected with the upper connecting piece 201 of the other support component 2, the other end of the sixth cross tube 106 is connected with the bottom connecting piece 202 of the other support component 2, in this embodiment, bottom connecting pieces 202 are hinged with linkage rod components 4.

On the basis of the technical schemes of any of the above-mentioned embodiments and their mutual combination, a rocking chair can be formed by arranging a cushion cloth on the the bracket for the rocking chair.

Figure 7:
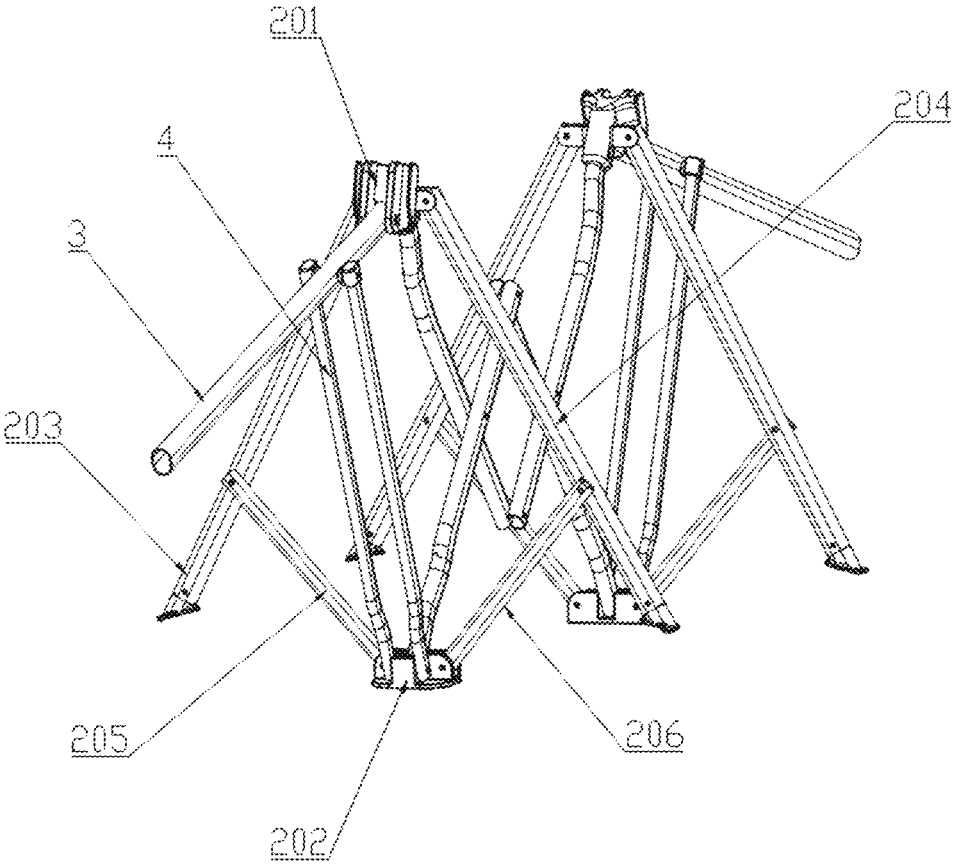
FIG. 7 is a schematic structural diagram of Embodiment 2 in a half-folded state of a bracket for a rocking chair of the invention.
Figure 8:
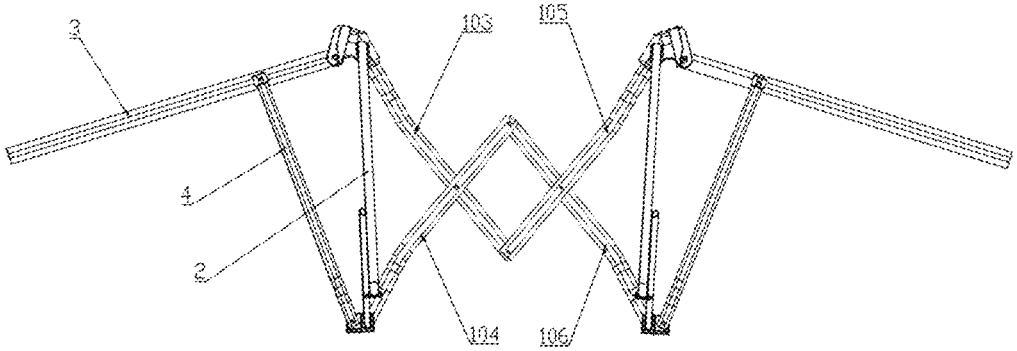
FIG. 8 is a schematic diagram of the front structure of Embodiment 2 in a half-folded state of a bracket for a rocking chair of the invention.
Figure 9:
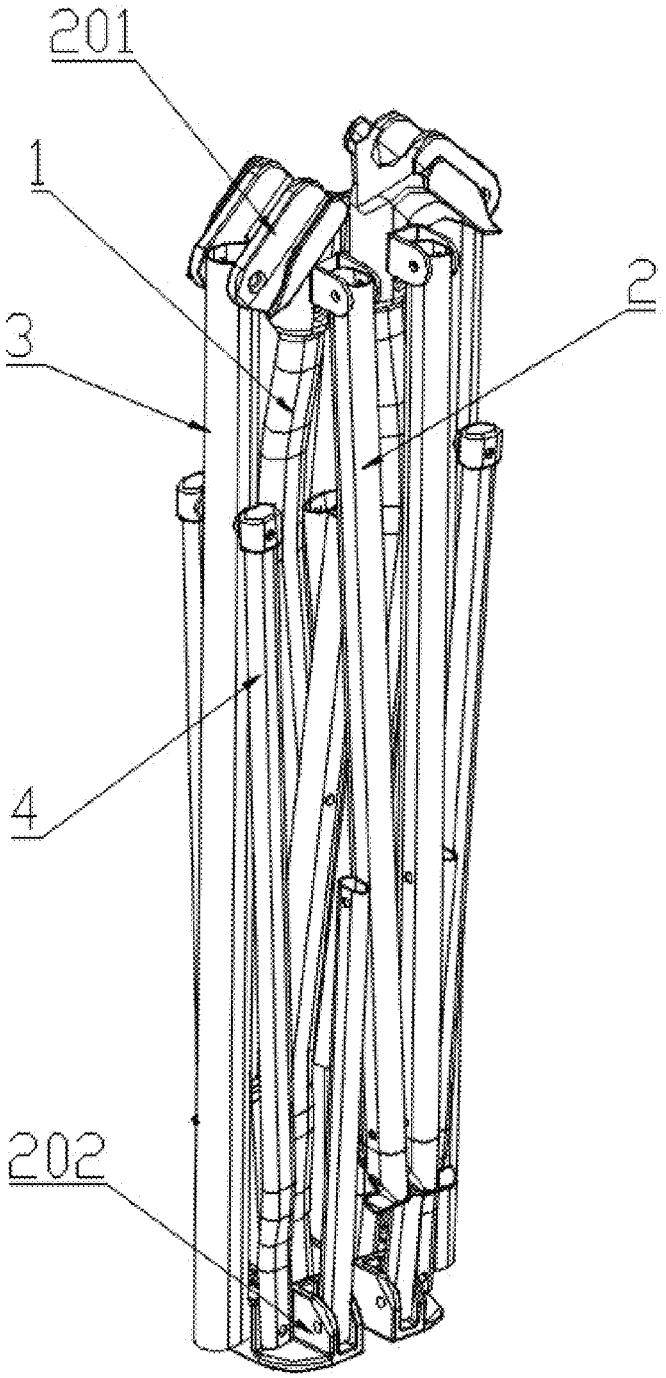
FIG. 9 is a schematic structural diagram of Embodiment 2 in a folded state of a bracket for a rocking chair of the invention.

Referring to FIG. 7-9, when the device is folded: firstly, the overturning rods are flipped downward around their hinged rotation points between them and the upper connecting pieces, at the same time, the linkage rods hinged on them are driven to move downwards, so that the linkage rods are separated from the upper connecting pieces, and the distances between the upper connecting pieces and the bottom connecting pieces are stretched, and the semi-folded state shown in FIG. 7 and FIG. 8 is reached, then the overturning rods continue to move downward to reach the state shown in FIG. 9 to realize folding; when the distances between the upper connecting pieces and the bottom connecting pieces increase, the support components and the central components are simultaneously driven to gather and fold, thereby, the bracket is fully folded.

When the device is opened: firstly, in the state of FIG. 9, one end of the overturning rods is lifted up, and the overturning rods rotate around the linkage rods at the hinged rotation points between them and the upper connecting pieces, the other end of the overturning rods drive the upper connecting pieces to move downward, In this process, the distances between the upper connecting pieces and the bottom connecting pieces become smaller until the overturning rods and the limiting grooves of the upper connecting pieces are stuck in one direction to achieve a locking state, when the bracket is stressed, the overturning rods move inward, at the same time, they are limited and stuck by the upper connecting pieces to realize automatic locking.

The invention and its embodiments are described above, this description is not restrictive, and what is shown is only one of the embodiments of the invention, and the actual structure is not limited to this. All in all, if those skilled in the art receives its enlightenment, without deviating from the object of the invention, and without creatively designing structures and embodiments similar to the technical scheme of the invention shall fall within the protection scope of the invention.

What is claimed is:

1. A bracket for a foldable chair, comprising a central cross component, two sets of support components, two overturning rods, and two sets of linkage rod components;

The two sets of support components are connected by the center cross component;

One end of each overturning rod is connected with a support component and can rotate at the position where the overturning rod is connected with the support component;

One end of each linkage rod component is connected with an overturning rod, and the other end is connected with the central cross component or a support component;

Wherein linkage rod components can move with the rotation of the overturning rods, at the same time, the movement of the linkage rod components can change the distance between the two sets of support components.

2. A bracket for a foldable chair of claim 1, each of the support component comprises two upper support rods, two lower support rods, an upper connecting piece and a bottom connecting piece, one end of the two upper support rods is hinged with the upper connecting piece respectively, one end of the two lower support rods is hinged with the bottom connecting piece respectively, and the other end is hinged with the two upper support rods respectively.

3. A bracket for a foldable rocking chair of claim 2, the upper connecting piece comprises an upper connecting piece main body and two U-shaped pieces, the two U-shaped pieces are symmetrically arranged on both sides of the upper connecting piece main body.

4. A bracket for a foldable chair of claim 3, the distance between the upper connecting piece and the bottom connecting piece changes when the linkage rod components rotate with the overturning rods, at the same time, the connection position between the two upper support rods and the two lower support rods changes.

5. A bracket for a foldable chair of claim 4, the two upper support rods are respectively the front upper support rod and the rear upper support rod, and the two lower support rods are respectively the front lower support rod and the rear lower support rod; the front upper support rod is hinged with the front lower support rod, and the rear upper support rod is hinged with the rear lower support rod, when the linkage rod components rotate with overturning rods, the hinged position of the front upper support rod and the front lower support rod changes, at the same time, the hinged position of the rear upper support rod and the rear lower support rod changes.

6. A bracket for a foldable chair of claim 4, upper connecting pieces and bottom connecting pieces are respectively connected with one end of the central cross component.

7. A bracket for a foldable chair of claim 6, the central cross component includes at least one set of cross tubes.

8. A bracket for a foldable chair of claim 7, the central cross component is a set of cross tubes, which includes a first cross tube and a second cross tube that are cross-hinged with each other, wherein one end of the first cross tube is connected to the upper connecting piece of one support component, and the other end is hinged with the bottom connection piece of the other support component; one end of the second cross tube is hinged with the bottom connection piece of one support component, and the other end is connected to the upper connection piece of the other support component.

9. A bracket for a foldable chair of claim 7, the central cross components are two sets of cross tubes, wherein one central cross component includes a third cross tube and a fourth cross tube hinged to each other, and the other central cross component includes a fifth cross tube and a sixth cross tube hinged to each other, wherein one end of the third cross tube is connected with the upper connecting piece of one support component, and the other end is hinged with one end of the fifth cross tube; one end of the fourth cross tube is connected with the bottom connecting piece of one support component, and the other end is hinged with one end of the sixth cross tube; the other end of the fifth cross tube is connected with the upper connecting piece of the other support component, the other end of the sixth cross tube is connected with the bottom connecting piece of the other support component.

10. A bracket for a foldable chair of claim 9, bottom connecting pieces are hinged with linkage rod components.

11. A bracket for a foldable chair according to any one of claims 1-10, wherein the rotation of one of the overturning rods can make the other overturning rod rotate or the two overturning rods can rotate simultaneously.

* * * * *